United States Patent [19]

Ono et al.

[11] Patent Number: 4,684,034

[45] Date of Patent: Aug. 4, 1987

[54] FOLDING CONTAINER

[75] Inventors: Tatsuo Ono, Funabashi; Akira Masuda, Matsudo; Kikuzo Kuramoto, Funabashi, all of Japan

[73] Assignee: Nisso Sangyo Co., Ltd., Japan

[21] Appl. No.: 690,142

[22] Filed: Jan. 10, 1985

[51] Int. Cl.[4] ..... B65D 6/18

[52] U.S. Cl. ..... 220/6; 220/1.5; 220/7

[58] Field of Search ..... 220/6, 7, 1.5, 76, 77, 220/78

[56] References Cited

U.S. PATENT DOCUMENTS

| | | | |
|---|---|---|---|
| 3,130,850 | 4/1964 | Oakey et al. | 220/6 |
| 3,223,274 | 12/1965 | Tolnai | 220/7 |
| 3,765,556 | 10/1973 | Baer | 220/6 |
| 3,796,342 | 3/1974 | Sanders et al. | 220/6 |
| 3,799,384 | 3/1974 | Hurkamp | 220/6 |
| 4,214,669 | 7/1980 | McQuiston | 220/6 |
| 4,240,555 | 12/1980 | Jurasek | 220/6 |
| 4,508,237 | 4/1985 | Kreeger et al. | 220/6 |

*Primary Examiner*—Joseph Man-Fu Moy
*Attorney, Agent, or Firm*—McGlew and Tuttle

[57] ABSTRACT

Container to be used when goods or materials are transported by a large truck, etc. from one place to another place. It consists of multiple walls and framework frames which can be folded or rotated to fold the container compact.

It is formed into a box when it contains goods or materials and folded compact when it is not in use.

9 Claims, 22 Drawing Figures

FIG.5
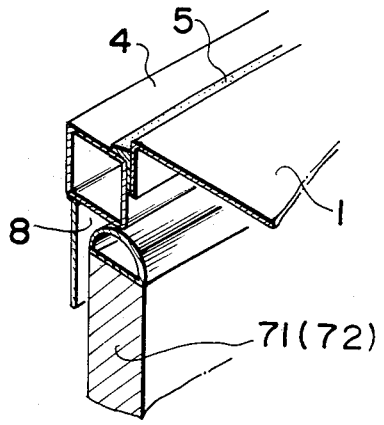
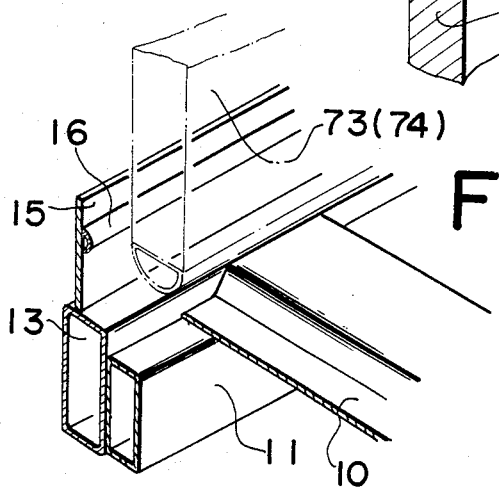
FIG.7
FIG.6
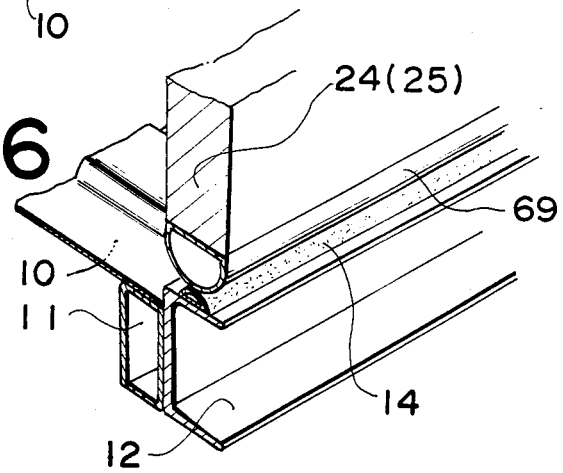

FIG. 8
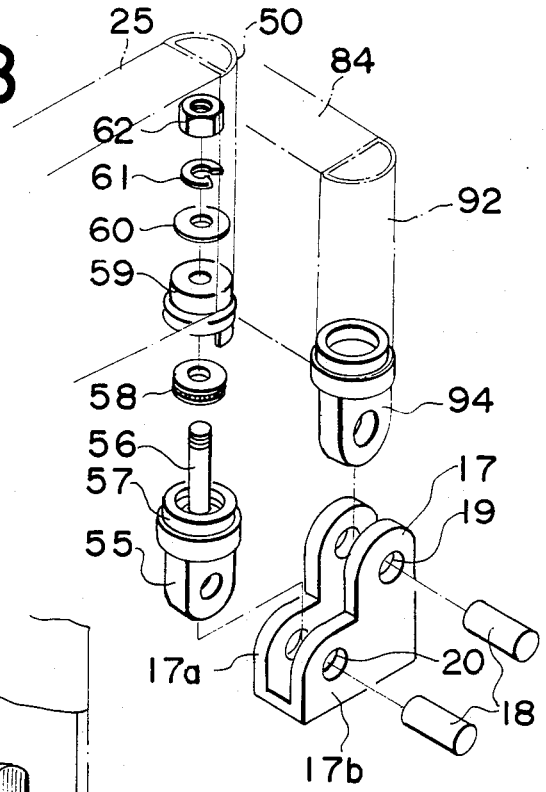
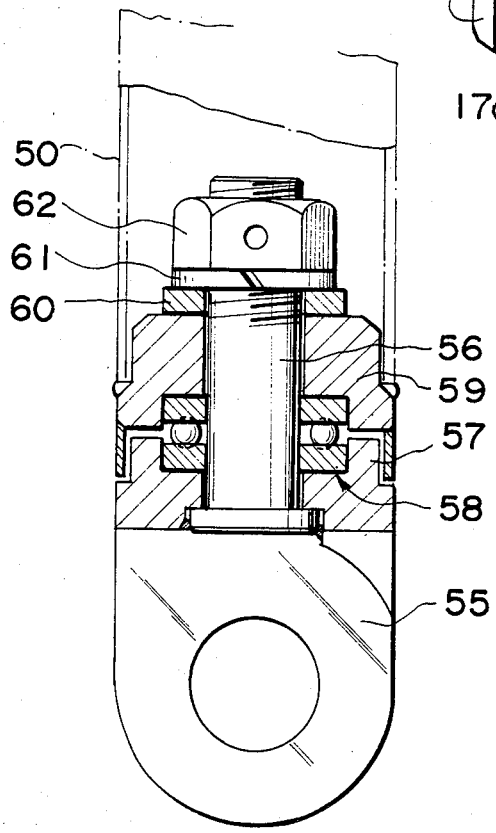
FIG. 9

FIG. 13a
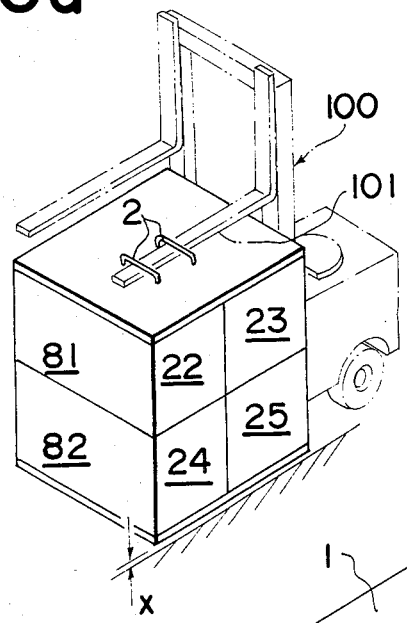
FIG. 13b
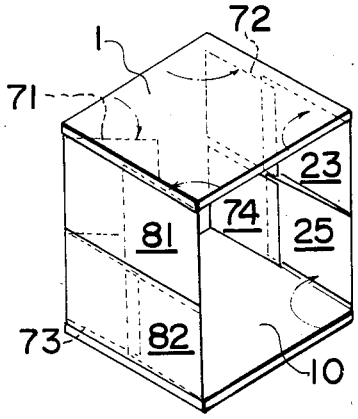
FIG. 13c
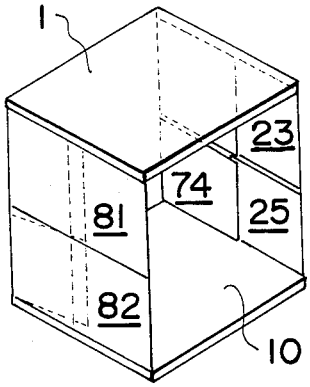
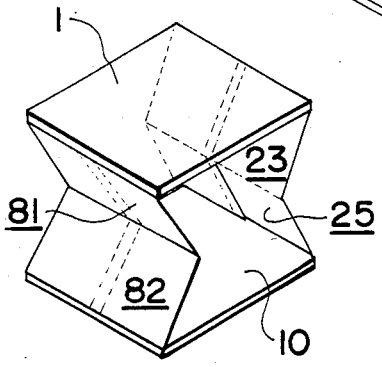
FIG. 13d
FIG. 13e
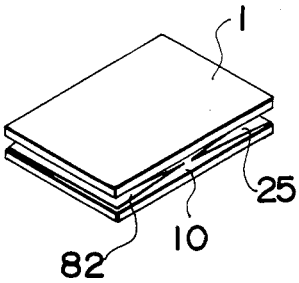

FOLDING CONTAINER

BACKGROUND OF THE INVENTION

This invention concerns a folding container to transport goods and materials.

When goods or materials are transported from one place to a faraway place using the rolling stock, large trucks, ships, etc. they are put in large cubic containers and transported safely to the destination.

Since these containers are cubic, they can be neatly loaded side by side on the vehicle without leaving wasteful dead space, and in the container many goods or materials can also be neatly arranged, and therefore, they can be safely transported without without being damaged.

But if, for example, no import cargoes are available from a foreign country to which export cargoes were sent by ship, or if no order for land transport back from a faraway place to which materials were sent, the used containers must be brought back empty.

In such cases, there was an economic disadvantage because the voluminous containers occupy a large space on the ship, truck or vehicle and the freight costs extra high.

SUMMARY OF THE INVENTION

Therefore, the objective of this invention is to provide a container which can be formed into a box when in use and can be folded compact when not in use.

Another objective of this invention is to provide a container which can be placed one upon another to pile up.

Still another objective of this invention is to provide a container which can be easily handled or carried by making its volume smaller.

Still another objective of this invention is to provide a container which can be easily transported without hitting an obstacle even in a narrow passage.

In order to achieve such objectives, this invention is made of multiple walls framework frames which are to be assembled, and the said multiple walls and frames can be partially or wholly folded or turned.

DESCRIPTION OF THE INVENTION

FIG. 5 is an enlarged sectional view cut at the Q—Q line of FIG. 1.

FIG. 6 is an enlarged sectional view cut at the R—R line of FIG. 1.

FIG. 7 is an enlarged sectional view cut at the S—S line of FIG. 1.

FIG. 8 is an exploded perspective view to show the linked relations between the bracket and framework frame.

FIG. 9 is an enlarged sectional view of part of the framework frame.

FIG. 13 is *(a)*, *(b)*, *(c)*, *(d)* and *(e)* are simplified perspective views to show the folding sequence of the container.

Figure 1:
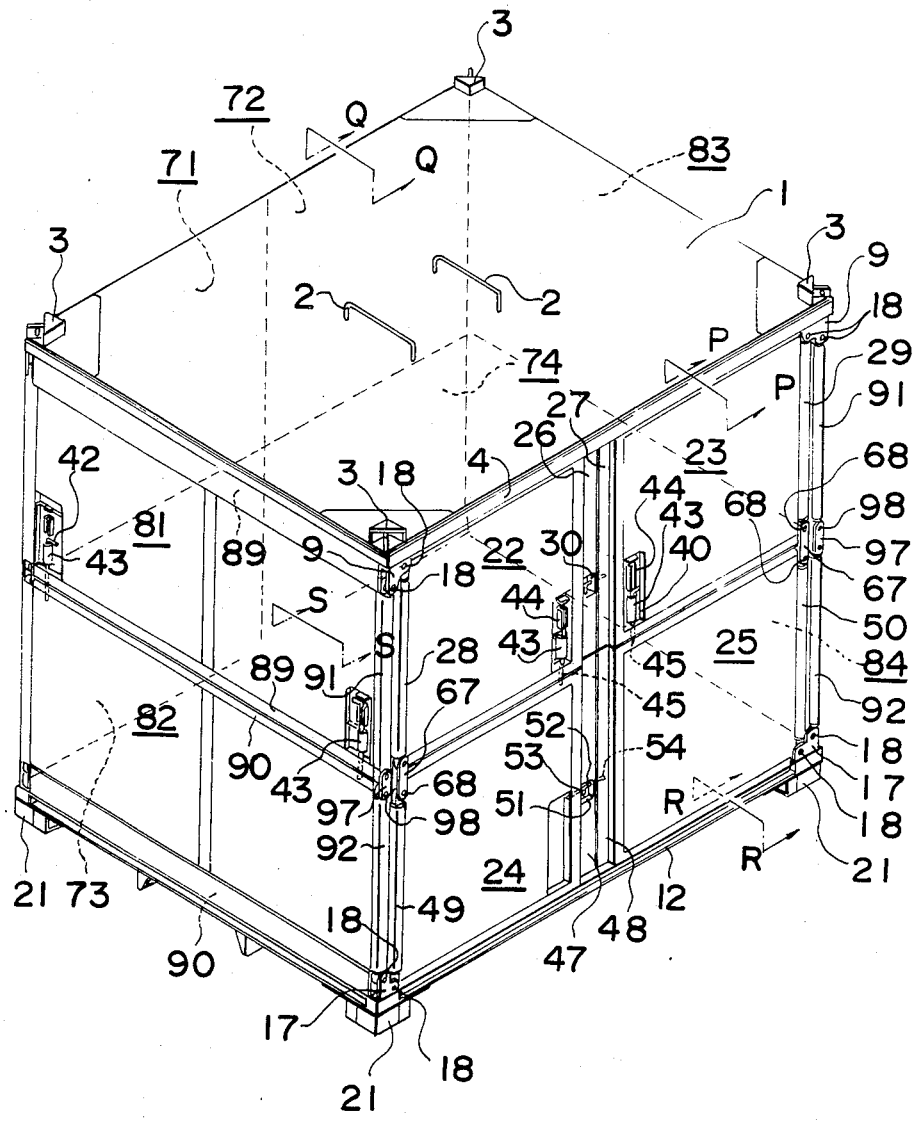
FIG. 1 is a perspective view of a container of an embodiment of this invention.

FIGS. 14 *(a)*, *(b)*, *(c)*, *(d)* and *(e)* are a simplified perspective view to show folding forms of other embodiments of this invention.

DESCRIPTION OF THE PREFERRED EMBODIMENT

The following will describe a preferred embodiment of this invention referring to the drawings.

Figure 2:
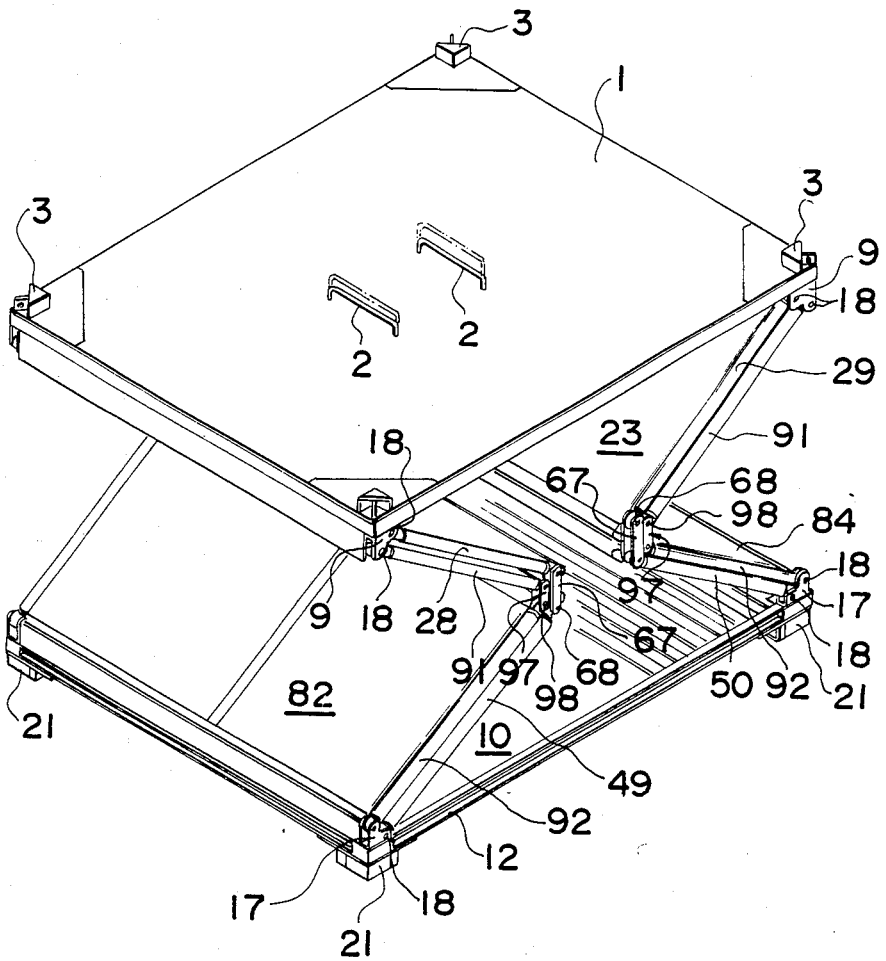
FIG. 2 is a perspective view of the container being folded.
Figure 3:
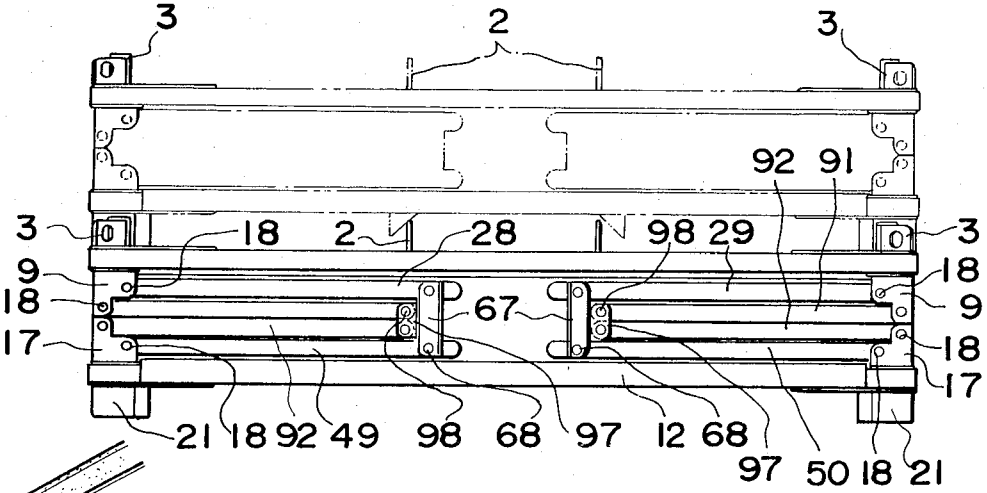
FIG. 3 is a front view of the container which is folded.
Figure 4:
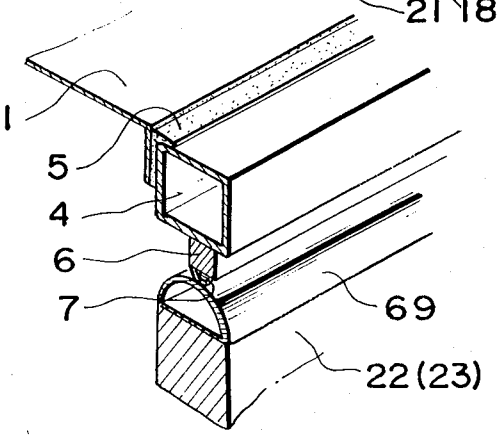
FIG. 4 is an enlarged sectional view cut at the P—p line of FIG. 1.

FIGS. 1, 2 and 3 show the entire container, and (1) is the top board made of iron material which is provided with 2 metal hooks (2) in the center and lifting lugs (3) on 4 corners. The metal hooks (2) are so shaped as to be hooked by the fork of a forklift and the lifting lugs (3) to be hooked by the hooking pins of a crane. Each of the 4 sides of the top board (1) is bent down to form a L and to the outside the square pipe reinforcement (4) is welded. (5) is a sealing material placed between the outer periphery of the top board (1) and the reinforcement (4). Such configuration is shown in detail in FIGS. 3 and 5. In FIG. 4, the reinforcing frame (4) on the front side of the top board (1) is provided with a fitting frame (6) on the underside to which a hollow sealing material made of rubber (7) is sticked as a weather strip. And in FIG. 5 a cover plate (8) is fixed (by welding, etc.) to the outside of the reinforcing frame (4) on the rear side and sides of the top board (1). (9) is a bracket fixed to the underside at both ends of the reinforcing frame (4) at the front and rear and supports pivotally the framework frame to be described later.

(10) is a corrugated plate of the same shape as that of the top board (1) is fixed to the square pipe supporting frame (11) provided at the front and rear and they are further fixed to a U-shaped reinforcing frame (12) at the front and both sides (FIG. 6) and to a square pipe reinforcing frame (13) at the rear (FIG. 7). On the said reinforcing frame (12) a sealing material (14) is sticked and on the said pipe-like reinforcing frame (13) a cover plate (15) is fixed by welding, etc. (16) is a sealing member sticked to the inside of the cover plate (15). (17) is a bracket fixed to the ends of the reinforcing frames (12) and (13) and is same as the aforementioned bracket (9). This bracket (17) consists, as shown in FIG. 8, 2 fitting pieces **(17*a*) and (17*b*) formed into a monolithic U-shape and is provided with 2 holes (19) and (20) for inserting the pin (18). (21) is a foot member which projects downward from the reinforcing frames (12) and (13) at both ends. The bracket (17) can be fixed not only directly but also via other fitting member to the reinforcing frames (12) and (13)**.

Figure 10:
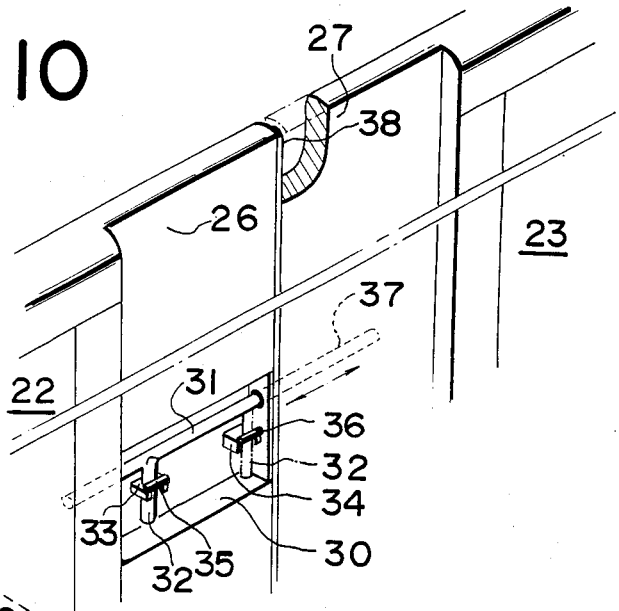
FIG. 10 is an enlarged perspective view of the locking mechanism of the front door.

In FIG. 1, (22), (23), (24) and (25) forms the front door in a set. The front door parts (22) and (23) are provided at the upper part and symmetrically shaped and are provided with L-shaped cutouts (26) and (27) at the mutually facing end and framework frames (28) and (29) on the opposite end. The said cutout (26) is provided with a dent (30) as shown in FIG. 10 and inside the dent (30) a locking bar (31) is provided piercing the dent walls and the locking bar (31) is provided with handles (32) in a projecting way. (33) and (34) are members to retain the handles (32) and retain the specified axial position of the locking bar (31). (35) and (36) are restraining pieces to prevent the retaining members (33) and (34) from coming off spontaneously and push the handles (32) inward by means of springs not illustrated. In the end face of the aforementioned cutout (27) facing the said locking bar (31) a long hole (37) is drilled horizontally. Therefore, the end part of the locking bar (31) can be inserted into the said long hole (37) by turning the handles (32), pushing open the restraining piece (35), thus brining the handle (32) out of the retaining member (33) and by pushing the handle (32) toward the front door part (23) side. Therefore, both front door parts (22) and (23) are locked by the locking bar (31) and the opening is restrained. (38) is a sealing member sticked to the end face of the front door part (22).

Figure 11:
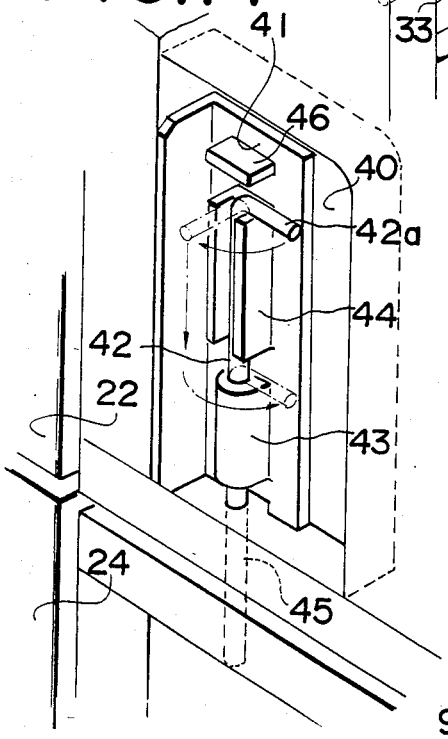
FIG. 11 is also an enlarged perspective view of another locking mechanism of the front door.

(39) and (40) are dents provided at the lower part of the door parts (22) and (23) and are provided with a locking mechanism shown in FIG. 11. In this figure, (41) is a mount provided in the dents (39) and (40), and on the mount (41) a locking bar (42) which slides vertically is supported by a guide member (43). The upper part of the locking bar (42) is bent into a l-shape to form a hook (42*a*) which is hooked to the retaining member (44) or turned and hooked to the end of the aforementioned guide member (43). The lower part of the locking bar (42) is designed to pierce the lower end of the front door parts (22) and (23), and when the locking bar (42) is pushed down and moved to the position where the hook part (42*a*) is hooked to the end of the guide member (43), the lower end of the locking bar (42) is inserted into the long hole (45) provided in the aforementioned front door parts (24) and (25). This makes the front door parts (22) and (24) and the front door parts (23) and (25) monolithic respectively. (46) is a restraining piece to fix the upper limit of the locking bar (42).

The said front door parts (24) and (25) are arranged correspondingly under the said front door parts (22) and (23) and are provided with L-shaped cutouts (47) and (48) on the mutually facing ends and framework frames (49) and (50) at the opposite ends. The said cutout (47) is provided with a dent (51) similar to that explained in FIG. 10 and inside the dent (51) a locking bar (52) to pierce the side walls of the dent is provided and it is inserted into or brought out of a long hole (54) provided in the end face of the front door part (25) by operating the handle (53) provided on the locking bar (52).

The upper end of the said framework framed (28) and (29) and the lower end of the framework frames (49) and (50) are pivoted to the brackets (9) and (17) by means of the pins (18) as shown in FIGS. 1 and 2.

The lower end of the framework frames (28) and (29) and the lower end of the framework frames (49) and (50) have the same universal joint structure. The structure will be explained referring to FIGS. 8 and 9. (55) is a rotating part to be pivoted to the fitting pieces (17*a*) and (17*b*) by means of the pin (18) and on its upper center a fitting shaft (56) is fixed. (57) is a fitting plate inserted on the fitting shaft (56) and on it a fitting plate (59) is supported in a rotating way via a bearing (58) and on the fitting plate (59) a lubricating member (60) is inserted. On the upper end of the fitting shaft (56) a bolt (62) is screwed via a washer (61). That is, the frames (28), (29), (49) and (50) can be rotated freely in relation to the rotating part (55) via the bearing (58).

Figure 12:
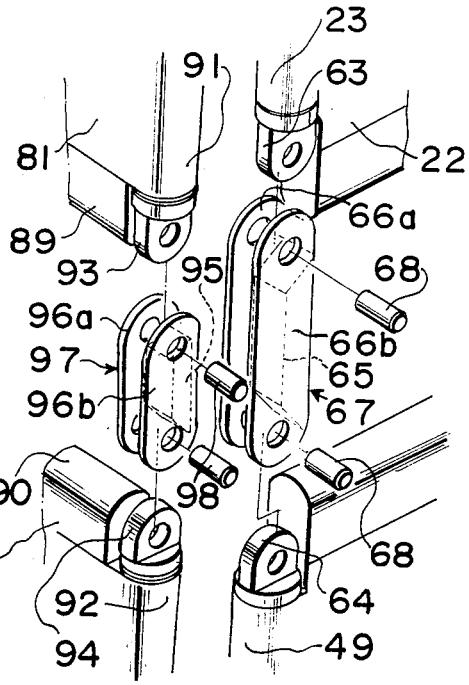
FIG. 12 is an enlarged exploded perspective view of the link mechanism.
Figure 14B:
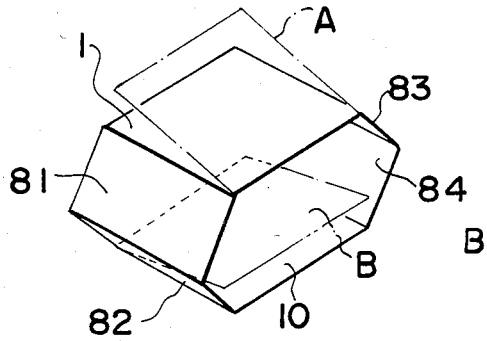
Figure 14A:
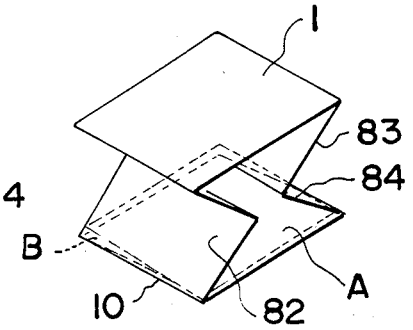
Figure 14C:
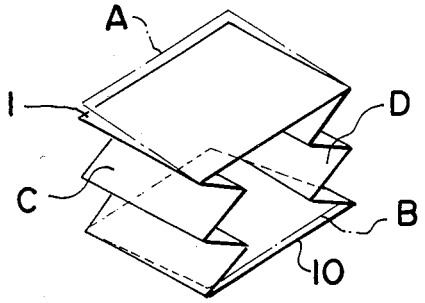
Figure 14D:
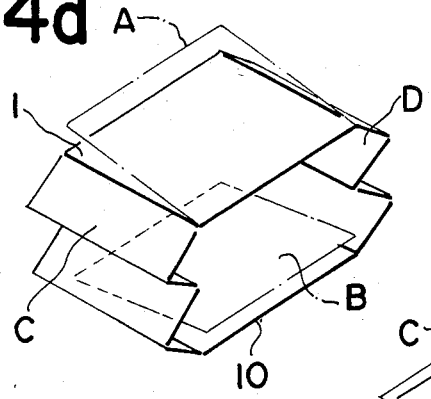
Figure 14E:
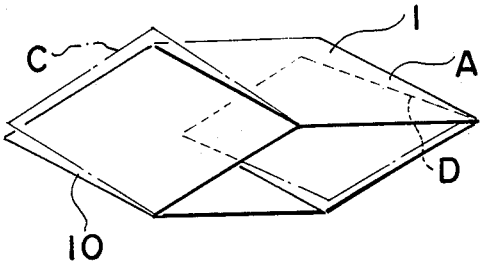

The link structure of the framework frames (28) and (49) and the link structure of the framework frames (29) and (50) will be explained referring to FIGS. 2 and 12. (63) and (64) are rotating parts adopting the same universal joint structure shown in FIG. 9, and these rotating parts (63) and (64) are pivoted by means of the pins (68) to each end of the link (67) which consists of a reinforcing member (65) sandwiched by 2 supporting pieces (66*a*) and (66*b*). That is, as clear from FIGS. 8, 9 and 12, the front door parts (22), (23), (24) and (25) can not only open backward or forward but also rotate (to be folded) centering on the pins (18) and (68).

On the upper end of the front door parts (22) and (23) and on the lower end of the front door parts (24) and (25) the seal member (69) is sticked as shown in FIGS. 4 and 6.

In FIG. 1, the rear door parts (71), (72), (73) and (74) have almost same rotating mechanism and fitting structure as those of the front door parts (22) and (25) and the difference is that the back door parts (71) and (72) are prevented from being opened outward by means of the cover plates (8) and (15) as shown in FIG. 5 and 7. Other same components bear the same symbols as those explained for the front door parts.

In FIGS. 1 and 2, (81) and (82) and (83) and (84) are upper and lower plates on the left and right sides and are provided with reinforcing members as required. At both lower ends of the left upper plate (81), the same locking bar (42) and guide member (43) as those provided in the front door parts (22) and (23) are provided.

The left side plates (81) and (82) are provided with horizontal framework frames (89) and (90) in a monolithic way at the upper and lower ends and with vertical frame work frames (91) and (92) also in a monolithic way at the side ends. These framework frames (91) and (92) are provided with the rotating parts (93) and (94) in a monolithic way at the lower and upper ends as shown in FIG. 12 and the rotating parts (93) and (94) are pivoted to both ends of a link (97) consisting of a reinforcing member (95) sandwiched by 2 supporting pieces (96*a*) and (6*b*) by means of the pins (98). The rotating parts (93) at the upper end of the framework frame (91) and the rotating part (94) at the lower end of the framework frame (92) are pivoted by means of the pins (18) to the inserting holes (19) of the aforementioned brackets (9) and (17).

Although a detailed illustration is omitted, the make-up and action of the right side plates (83) and (84) are same as those explained for the left side plates (81) and (82), and therefore, duplicated explanation is omitted. Therefore, the same components bear the same symbols.

The container thus made up is assembled into a box and the fork (101) of a forklift (100) is inserted into the metal hook (2) on the top board (1) as shown in FIG. 13 (*a*) and the whole container is raised from the ground by a small dimension x, and then the locking bars (31) and (42) of the front door parts (22), (23), (24) and (25) are drawn out of the long holes (37) and (45) to release the monolithic combination of the door parts (22), (23), (24) and (25).

Then, by manual operation, the door parts (22), (23), (24) and (25) can be folded inward centering on the framework frames (28), (29), (49) and (50) to stick to the inside of the right and left side plates as shown in FIG. 13 (*b*). The back door parts (71), (72), (73) and (74) can also be folded inward in the same way. In such a case, the cutouts (26) and (75), (27) and (76), (47) and (77) and (48) and (78) are mutually matched as shown in FIG. 13 (*c*). Thus the folded door parts form uniform surfaces.

Then the left side plates (81) and (82) and right side plates (83) and (84) are set free by drawing the locking bars (42) from the long holes (87) and (88). Then the left side plates (81) and (82) and right side plates (83) and (84) are folded inward as shown in FIG. 13 (*d*). Consequently the framework frames (91) and (92) together with the aforementioned framework frames (28), (49), (29) and (50) are folded centering on the brackets (9) and (17) as shown in FIG. 2. Then, by removing the fork (93) and applying a load to the top board (1), the container is folded into a thin form as shown in FIG. 13 (*e*). This state is shown in FIG. 3.

As explained above, after the contents is discharged, the container can be easily folded and its occupying space in a vehicle, etc. can be reduced.

FIG. 14 (*a*) (*b*) (*c*) (*d*) (*e*) shows possible folding patterns, and in FIG. 14 (*a*) the front door A consisting 4 door parts and back door B consisting of 4 door parts which can be independently opened or closed as in FIG. 1 are folded on the corrugated plate (10) and then the left side plates (81) and (82) and right side plates (83) and (84) are folded inward. In FIG. 14 (*b*) the doors A and B are folded on the top board (1) and corrugated plate (10) respectively and then the side plates (81), (82), (83) and (84) are folded outward. In FIG. 14 (*c*) the doors A and B are folded as in the preceding figure and the left side plate C and right side plate D are folded inward at 3 points. In FIG. 14 (*d*) the left side plate C and right side plate D are folded outward at 3 points. In FIG. 14 (*e*) both side plates C and D are folded outward and the top board (1), corrugated plate (10) and front door A and back door B are pushed into a rhombus and then both side plates C and D are folded onto them. The possible folding patterns are not limited to the above.

As explained above, this invention concerns a container which consists of the assembly of multiple walls and framework frames which can be partially or wholly folded or turned, thus making it possible to pile up many containers when they must be brought back empty and to reduce the transportation cost. Also the reduced volume makes it easier for the worker to handle and carry the container. Furthermore, the folded containers can be piled up on one pallet. Furthermore, for example, in a narrow passage or space in a factory, when the container is hanged and transported by a crane, etc., the folded container can be easily transported without hitting an obstacle.

The container can be folded by manual pushing or pulling, with its own weight when it is hanged and then lowered on the ground by a winch or crane, or utilizing the force of hydraulic cylinders installed inside or outside the container.

What is claimed is:

1. A folding container comprising a top wall, a bottom wall spaced from said top wall with said container in an unfolded condition, a pair of opposite side walls each connected betwen said top and bottom walls and on opposite sides of said wall comprising an upper portion pivotally mounted to opposite sides of said top wall and a lower portion pivotally mounted to opposite sides of said bottom wall, said upper and lower portions of each side wall being pivotally mounted to each other, said side walls being foldable inwardly for moving said top and bottom walls together to move said container into a closed position, each of said front and rear walls comprising a pair of upper portions pivotally mounted to respective upper portions of said side walls, and a pair or lower portions pivotally mounted to respective lower portions of said side walls, one side of said upper and lower portions of said rear and front walls being pivotal inwardly against said upper and lower portions of said side walls and other side of said upper and lower portion of said rear and front walls being against said top and bottom walls when said container is in its folded position.

2. A container according to claim 1 wherein each of said top and bottom walls include four corners, outer frames connected between said four corners of said top wall and said four corners of said bottom wall, each outer frame having an upper portion connected to said upper portions of said side walls and a lower portion connected to said lower portion of said walls, locking means connectable between said upper and lower portions of said outer frames for locking said upper and lower portions of said outer frames together in said unfolded position of said container, inner frames connected to said outer frames, said inner frames having portions for pivotally supporting each portion of said front and rear walls, and further locking means engageable between upper and lower portions of said front and rear walls for holding said container in its unfolded position.

3. A container according to claim 2, wherein said upper and lower portions for each outer frame include ends which are adjacent each other, a rotating part connected to each of said adjacent ends of said upper and lower portions of said outer frame, said rotating parts being pivotally connected to each other for pivotally connecting said upper and lower portions of each side wall together.

4. A container according to claim 3, wherein said inner frame include upper and lower portions having ends which are adjacent to each other, further rotating parts connected to said adjacent ends of said upper and lower portions of said inner frames, said further rotating parts being pivotally mounted to each other in an inward direction which is the same as an inward direction of pivoting of said first-mentioned rotating part.

5. A container according to claim 4, including a first link pivotally connected between said first-mentioned rotating parts of said upper and lower portions of said outer frames and a second link pivotally connected between said further rotating parts of said upper and lower portions of said inner frame, said first link being shorter than said second link.

6. A folding container comprising a top wall, a bottom wall spaced from said top wall with said container in an unfolded condition, a pair of opposite side walls each connected between said top and bottom walls and on opposite sides of said top and bottom walls, a front wall and a rear wall, each side wall comprising an upper portion pivotally mounted to opposite sides of said top wall and a lower portion pivotally mounted to opposite sides of said top wall and a lower portion pivotally mounted to opposite sides of said bottom wall, said upper and lower portions of said wall having outer edges which are adjacent said front and rear walls respectively, an outer frame connected to said outer edges of said upper and lower portions of said side walls, said outer frame including upper portions connected to said outer edges of said upper portions of said side walls and lower portions of said side walls, said upper and lower portions of said outer frame at each other edge being pivotally connected to each other for pivotally connecting said upper and lower portions of said side walls together for inward folding to permit movement of said top and bottom walls together to fold said container, said upper and lower portions of said side walls being free of pivotal connections between said outer edges, said front and rear walls being pivotally connected to said outer frame for moment from an unfolded position to a folded position.

7. A container according to claim 6, wherein said upper portions of said outer frame are pivotally connected to corners of said top wall and said lower portions of said outer frame are pivotally connected to corners of said bottom wall, said pivotal connections of said upper and lower portion of said outer frame to said top and bottom walls respectively pivotally supporting said upper and lower portions of said side walls to said top and bottom walls respectively.

8. A container according to claim 7, including front and rear inner frames each having upper portions pivotally connected to corners of said top wall and lower portions pivotally connected to corners of said bottom wall, said upper and lower portions of said inner frame being pivotally connected to each other between said top and bottom walls, a front wall and a rear wall, each of said front and rear walls comprising a pair of upper portions pivotally mounted to said upper portion of said inner frame and a pair of lower portions pivotally mounted to said lower portions of said inner frame, said front and rear wall portions being pivotable inwardly of said container into a position substantially parallel to said respective upper and lower portions of said side walls and said inner and outer frames being pivotal inwardly to move said top and bottom walls together to fold said container.

9. A container according to claim 8, including a first link pivotally connected between said upper and lower portions of said outer frame and a second link pivotally connected between said upper and lower portions of said inner frame, said first link being shorter than said second link.

* * * * *